US007261507B2

(12) United States Patent
Horii et al.

(10) Patent No.: US 7,261,507 B2
(45) Date of Patent: Aug. 28, 2007

(54) BOOK BINDING METHOD AND SYSTEM FOR SADDLE STITCHED BOUND BOOKLET

(75) Inventors: Yoshiyuki Horii, Kyoto (JP); Eiji Katayama, Shiga (JP); Masayuki Kashiba, Shiga (JP); Ko Ouchiyama, Shiga (JP); Kazuhisa Fujita, Shiga (JP); Tomonori Yachi, Kyoto (JP); Takakazu Hori, Shiga (JP); Hisahiro Hirayama, Shiga (JP)

(73) Assignee: Horizon International Inc., Shiga (JP)

( * ) Notice: Subject to any disclaimer, the term of this patent is extended or adjusted under 35 U.S.C. 154(b) by 386 days.

(21) Appl. No.: 10/349,848

(22) Filed: Jan. 23, 2003

(65) Prior Publication Data

US 2003/0214092 A1 Nov. 20, 2003

(30) Foreign Application Priority Data

Jan. 25, 2002 (JP) ..... 2002-016584
Apr. 24, 2002 (JP) ..... 2002-121899

(51) Int. Cl.
*B42B 2/00* (2006.01)

(52) U.S. Cl. ..... 412/35; 412/6; 412/33

(58) Field of Classification Search ..... 412/1, 412/6, 9, 11, 33, 35; 270/32, 37, 52.18, 52.26, 270/52.29

See application file for complete search history.

(56) References Cited

U.S. PATENT DOCUMENTS 4,085,927 A 4/1978 Muller
4,592,651 A 6/1986 Oikawa et al.
4,898,373 A * 2/1990 Newsome ..... 270/52.29
4,917,366 A * 4/1990 Murakami et al. ..... 270/58.09
4,957,284 A 9/1990 Brabant
5,108,081 A 4/1992 Russel et al.
5,779,232 A 7/1998 Ochsner
6,095,740 A * 8/2000 Hollenstein et al. ..... 412/4

(Continued)

FOREIGN PATENT DOCUMENTS

EP 0038 942 A 11/1981

(Continued)

*Primary Examiner*—Monica Carter
*Assistant Examiner*—Eric A. Gates
(74) *Attorney, Agent, or Firm*—Hodgson Russ LLP

(57) ABSTRACT

A book binding system for a saddle-stitched bound booklet comprises a sheet feeding section (1) feeding sheets or sets of sheets (P) one by one, a sheet folding section (3) sequentially receiving a sheet or a set of sheets (P) from the sheet feeding section (1) and folding the sheet or the set of sheets (P) along the center line thereof, a sheet stacking section (4) stacking the sheet or the set of sheets (P) folded by the sheet folding section (3) in such a manner that the folded sheets or the folded sets of sheets are aligned with each other with respect to the fold lines thereof, a sheet stitching section (5) receiving a stack of the sheets or the sets of sheets (P') from the sheet stacking section (4) each time the predetermined number of the sheets or the sets of sheets (P) are stacked in the sheet stacking section, and stitching the stack of the sheets or the sets of sheets (P') at the fold line thereof, and a control section (46) controlling operation of the sheet feeding section (1), the sheet folding section (3) and the sheet stitching section (5).

12 Claims, 8 Drawing Sheets

U.S. PATENT DOCUMENTS

| | | | | |
|---|---|---|---|---|
| 6,099,225 | A * | 8/2000 | Allen et al. | 412/32 |
| 6,708,967 | B1 * | 3/2004 | Trovinger et al. | 270/52.26 |
| 6,808,479 | B2 * | 10/2004 | Trovinger et al. | 493/442 |
| 6,878,104 | B2 * | 4/2005 | Trovinger et al. | 493/445 |
| 2003/0002955 | A1 * | 1/2003 | Silberbauer | 412/35 |
| 2004/0071529 | A1 * | 4/2004 | Kawatsu et al. | 412/35 |

FOREIGN PATENT DOCUMENTS

| | | |
|---|---|---|
| FR | 2 778 361 | 11/1999 |
| JP | 11-023387 | 8/2000 |

* cited by examiner

BOOK BINDING METHOD AND SYSTEM FOR SADDLE STITCHED BOUND BOOKLET

BACKGROUND OF THE INVENTION

The present invention relates to a book binding method and a book binding system for manufacturing a saddle-stitched booklet.

FIG. 8 is a front view schematically illustrating a constitution of a conventional saddle stitching bookbinding system. In FIG. 8, the numeral 51 designates a collating machine having a plurality of sheet feeders 51*a* aligned in a vertical direction. The sheet feeders 51*a* supply sheets P1-Pn which make different pages, one by one, respectively. The numeral 52 designates a saddle stitching machine and the numeral 53 designates a press roller. The numeral 54 designates a table for receiving saddle-stitched bound booklets and the numeral 55 designates a saddle-stitched bound booklet. The numeral 51*b* designates a conveyor belt 51*b* conveying a set of sheets P comprised of gathering of the sheets. The saddle stitching machine is provided with a conveying belt 52*a* conveying the set of sheets P to a stitching station, a stitching head 52*c* arranged for vertical movement at the stitching station so as to drive a stitching wire into the center portion of the set of sheets P, a stopper 52*b* for positioning the set of sheets P conveyed on the conveying belt 52*a* in place, conveying belts 52*d* conveying the stitched set of sheets to a folding station, a folding knife 52*e* arranged for reciprocating motion so as to fold the stitched set of sheets along its center line, a stopper 52*d* for positioning the set of sheets conveyed on the conveying belts 52*d* and a pair of nip rollers 52*g* providing the stitched set of sheets pushed forwardly by the folding knife 52*e* with the definite fold line.

However, according to the conventional book binding system, a set of sheets and thereafter folding the stitched set of sheets along the center line thereof, as the number of sheets forming a booklet increases, the fold line of the bounded booklet is rounded and bulged, which causes a problem of degradation in appearance and feature of the booklet.

Furthermore, in the above-mentioned conventional book binding system, the motion of the collating machine is synchronized with the motion of the post-processing machine such as the sheet stitching unit, the sheet folding unit and so on by activating the collating machine at slower speed than a processing speed of the post-processing machine and starting the post-processing machine upon detection of reception of the stack of sheets, which causes a problem that both the working speed of the collating machine and the processing speed of the post processing machine are restricted so that the whole speed of the book binding processing cannot be increased.

SUMMARY OF THE INVENTION

Therefore, it is an object of the present invention to provide a book binding method and a book binding system which is capable of manufacturing a saddle stitched bound booklet with a neat fold line and good appearance even when the number of sheets forming the booklet increases, and which is capable of optimally synchronize a motion of post-processing machines with a motion of a collating machine so as to increase the processing speed of book binding.

In accordance with the present invention, the above object is achieved by a book binding method for a saddle-stitched bound booklet, comprising the steps of: folding a sheet or a set of sheets along the center line thereof one by one; stacking the folded sheet or the folded set of sheets in such a manner that the folded sheets or the folded sets of sheets are aligned with each other with respect to their fold lines; and stitching the stacked sheets or the stacked sets of sheets at the fold lines thereof to form a booklet.

In accordance with the present invention, the above object is also achieved by a book binding system for a saddle stitched bound booklet, comprising: a sheet feeding section feeding sheets or sets of sheets one by one; a sheet folding section sequentially receiving a sheet or a set of sheets from the sheet feeding section and folding the sheet or the set of sheets along the center line thereof; a sheet stacking section stacking the sheet or the set of sheets folded by the sheet folding section in such a manner that the folded sheets or the folded sets of sheets are aligned with each other with respect to the fold lines thereof; a sheet stitching section receiving a stack of the sheets or the sets of sheets from the sheet stacking section each time the predetermined number of the sheets or the sets of sheets are stacked in the sheet stacking section, and stitching the stack of the sheets or the sets of sheets at the fold line thereof; and a control section controlling operation of the sheet feeding section, the sheet folding section and the sheet stitching section.

According to a preferred embodiment of the present invention, the book binding system further comprises a frame, and the sheet folding section comprises: a sheet positioning table attached to the frame for sequentially receiving the sheet or the sets of sheets from the sheet feeding section and positioning the sheet or the set of sheets in place, a sheet conveying path extending from the sheet positioning table to the sheet stacking section, the sheet positioning table positioning the sheet or the set of sheets such that the center line of the sheet or the set of sheets aligns with the center line of the sheet conveying path; upper and lower horizontal rotating shafts attached to the frame at the entrance of the sheet folding section with the sheet conveying path therebetween and extending in the direction transverse to the sheet conveying path; a drive mechanism attached to the frame for rotating the upper horizontal rotating shaft; upper and lower creasing rollers fixed to the upper and lower horizontal rotating shafts, respectively, the upper and lower creasing rollers being disposed at the position corresponding to the center line of the sheet conveying path and bringing their outer periphery surfaces into contact with each other, the upper creasing roller being provided with a groove extending about the outer periphery thereof, the lower creasing roller being provided with a protrusion extending about the outer periphery thereof correspondingly with the groove, the groove and the protrusion being disposed at a position corresponding to the center line of the sheet conveying path, the sheet or the set of sheets on the sheet positioning table being nipped between the upper and lower creasing rollers and provided with an inverted V-shaped fold line thereon; at least one horizontal support shaft attached to the frame at a downstream side of the horizontal rotating shafts; a guide roller rotatably attached to the at least one horizontal support shaft at a position corresponding to the center line of the sheet conveying path, an outer periphery edge thereof upwardly pushing the fold line of the sheet or the set of sheets traveling on the sheet conveying path; a pair of vertical support shafts attached to the frame at the exit of the sheet folding section and extending downwardly from the frame across the sheet conveying path at the both sides of the center line of the sheet conveying path; a pair of press rollers rotatably attached to the lower ends of the vertical support shafts, each of the press rollers being composed of a large radius portion and a small radius portion connecting to the underside of the large radius portion, the press rollers bringing their outer periphery surfaces into contact with each other, the sheet or the set of sheets being nipped at its peripheral portion folded along the fold line between the press rollers and fed downstream; pulleys fixed to the upper horizontal rotating shaft at both sides of the upper creasing roller; and a first endless belt extending between the pulley and the small radius portion of the press roller at one side of the center line of the sheet conveying path, and a second endless belt extending between the pulley and the small radius portion of the press roller at the other side of the center line of the sheet conveying path, portions of the first and second endless belts which travel in a feeding direction of the sheet or the set of sheets contacting with a top surface of the sheet or the set of sheets and gradually narrowing the spacing therebetween towards the exit of the sheet folding section; whereby the sheet or the set of sheets is folded into an inverted V-shape along the center line thereof by being passed between the upper and lower creasing rollers, conveyed along the sheet conveying path by the at least one guide roller and the first and second endless belts and passed between the pair of pressing rollers.

According to further preferred embodiment of the present invention, the sheet stacking section comprises: a saddle-shaped pair of support plates attached to the frame at the downstream side of the sheet folding section and extending in a direction of the sheet conveying path of the sheet folding section with a spacing therebetween for supporting the sheets or the sets of sheets folded into an inverted V-shape by the sheet folding section thereon. The sheet stitching section comprises: a saddle-shaped pair of support plates connecting to the pair of support plates of the sheet stacking section; a sheet stitching station provided on the second pair of support plates; a sheet conveying mechanism conveying a stack of the sheets or the sets of sheets from the sheet stacking section to the sheet stitching station when the predetermined number of the folded sheets or the folded sets of sheets are stacked in the sheet stacking section; a stitching wire drive head attached to the frame above the top end spacing between the second pair of support plates at the sheet stitching station for vertical movement, the stitching wire drive head being movable between a standby position in which the stitching wire drive head separates from the top end spacing and a stitching position in which the stitching wire drive head contacts with the stack of the sheets or the set of sheets supported on the second pair of support plates so as to drive the stitching wire into the fold line of the stack; a stitching wire bending block attached to the frame below the top end spacing between the second pair of support plates at the sheet stitching station for vertical movement, the stitching wire bending block being movable between a standby position in which the stitching wire bending block separates from the top end spacing between the second pair of support plates and a stitching position in which the stitching wire bending block contacts with the stack of the sheets or the sets of sheets so as to support the stack thereon; and a drive mechanism for moving the stitching wire drive head and the stitching wire bending block in such a manner that the stitching wire bending block is in its stitching position upon the stitching position of the stitching wire drive head and in its standby position upon the standby position of the stitching wire drive head.

According to further preferred embodiment of the present invention, the sheet conveying mechanism of the sheet stitching section comprises: a motor attached to the frame and having a horizontal drive shaft; an index unit attached to the frame and having a horizontal input rotary shaft and a horizontal output rotary shaft, the index unit being adapted to halt rotation of the output rotary shaft for the predetermined time duration of rotation of the input rotary shaft, the input rotary shaft being operatively connected to the drive shaft of the motor through a clutch/brake unit; at least one drive sprocket fixed to the output rotary shaft of the index unit: at least one horizontal sprocket support shaft fixed to the frame; at least one idle sprocket rotatably attached to the sprocket support shaft; at least one endless chain extending among the drive and idle sprockets in a vertical plane, the upper linear portion of the endless chain traveling along the top end spacing of the support plate pairs of both the sheet stacking section and the sheet stitching section; and a conveying claw fixed to the at least one endless chain; whereby the stack of the sheets or the sets of sheets are conveyed along the support plate pairs of the sheet stacking section and the sheet stitching section by the conveying claw pushing a trailing edge of the stack with circulating of the at least one endless chain According to further preferred embodiment of the present invention, the control section measures time from start up of operation of the sheet feeding section to stacking of the predetermined number of the sheets or the sets of sheets in the sheet stacking section so as to determined the timing of operation of the sheet stitching section and record a value of the determined timing upon pre-operation of the system, and measures time elapsed from reception of the stack by the sheet stitching section and sends a start up signal of operation to the sheet feeding section each time the measured time equals to the recorded value of the timing in operation of the system.

According to further preferred embodiment of the present invention, the control section comprises: a sheet sensor disposed between the sheet folding section and a sheet stacking section for detecting passage of the predetermined number of the sheets or the sets of sheets; a subsidiary rotary shaft coaxially coupled to the input rotary shaft of the index unit; a pulse plate fixed to the subsidiary rotary shaft for generating a pulse every time it rotates a given amount of angle; an encoder for counting pulses generated by the pulse plate; a disc fixed to the subsidiary rotary shaft and having a extension strip at its periphery; an initial position sensor for detecting an initial position of the conveying claw of the sheet conveying mechanism of the sheet stitching section in which the conveying claw is positioned at an upstream side of the sheet stacking section by detecting the extension strip of the disc; and a processing unit measuring time from start up of operation of the sheet feeding section to stacking of the predetermine number of the sheets or the sets of sheets in the sheet stacking section based on a detection signal from the sheet sensor so as to determine the timing of operation of the sheet stitching section and record a value of the determined timing in a memory upon pre-operation of the system, and measuring time elapsed from reception of the stack by the sheet stitching section based on the counted value of the encoder, and sending a start up signal of operation to the sheet feeding section each time the measured time equals to the recorded value of the timing in operation of the system.

BRIEF DESCRIPTION OF THE DRAWINGS

The above and other objects and the nature and advantages of the present invention will become more apparent from the following detailed description of an embodiment taken in conjunction with the drawings, wherein.

DETAILED DESCRIPTION OF PREFERRED EMBODIMENT

Figure 1:
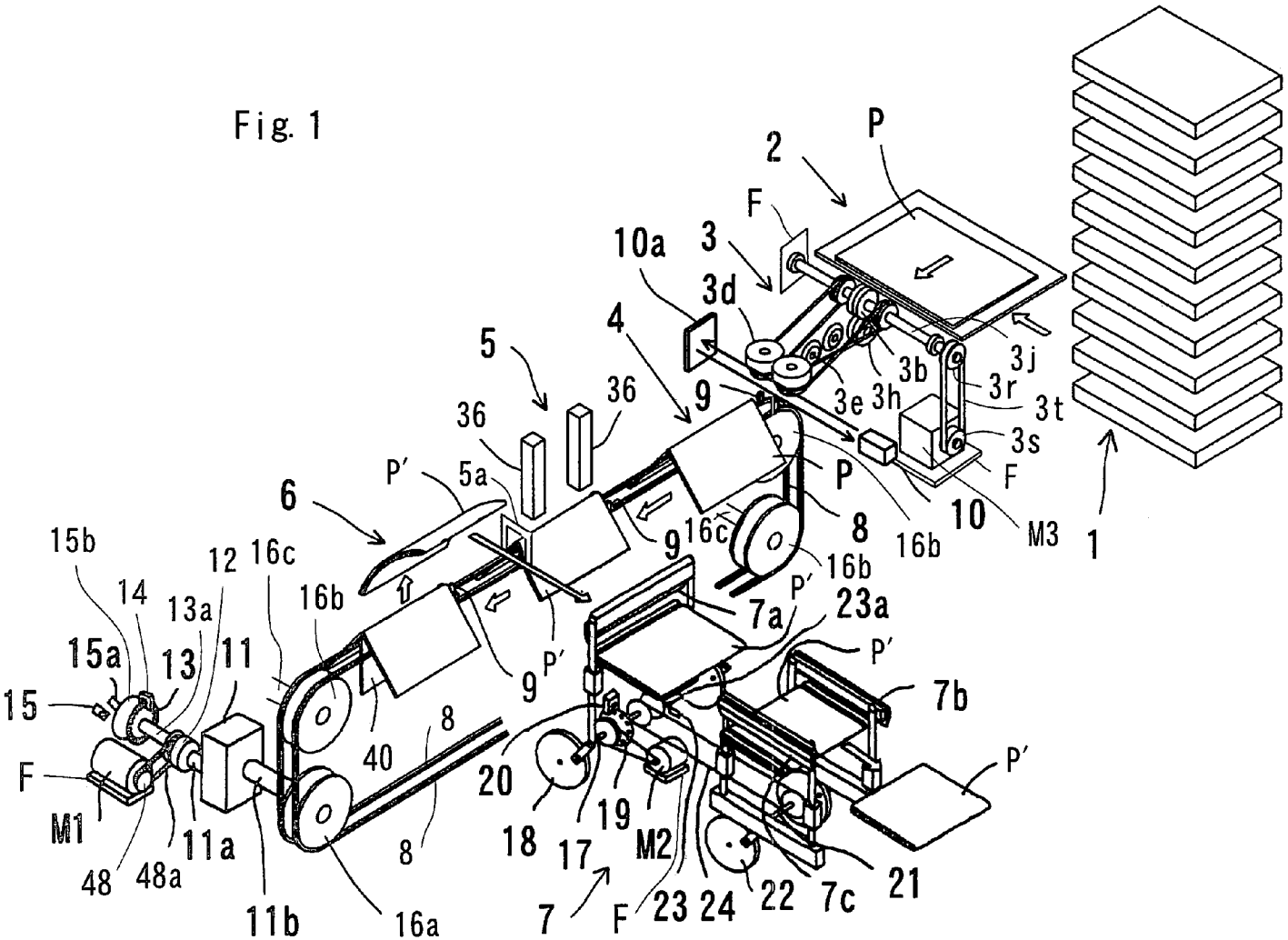
FIG. 1 is a schematic perspective view of a book binding system according to an embodiment of the present invention.
Figure 2:
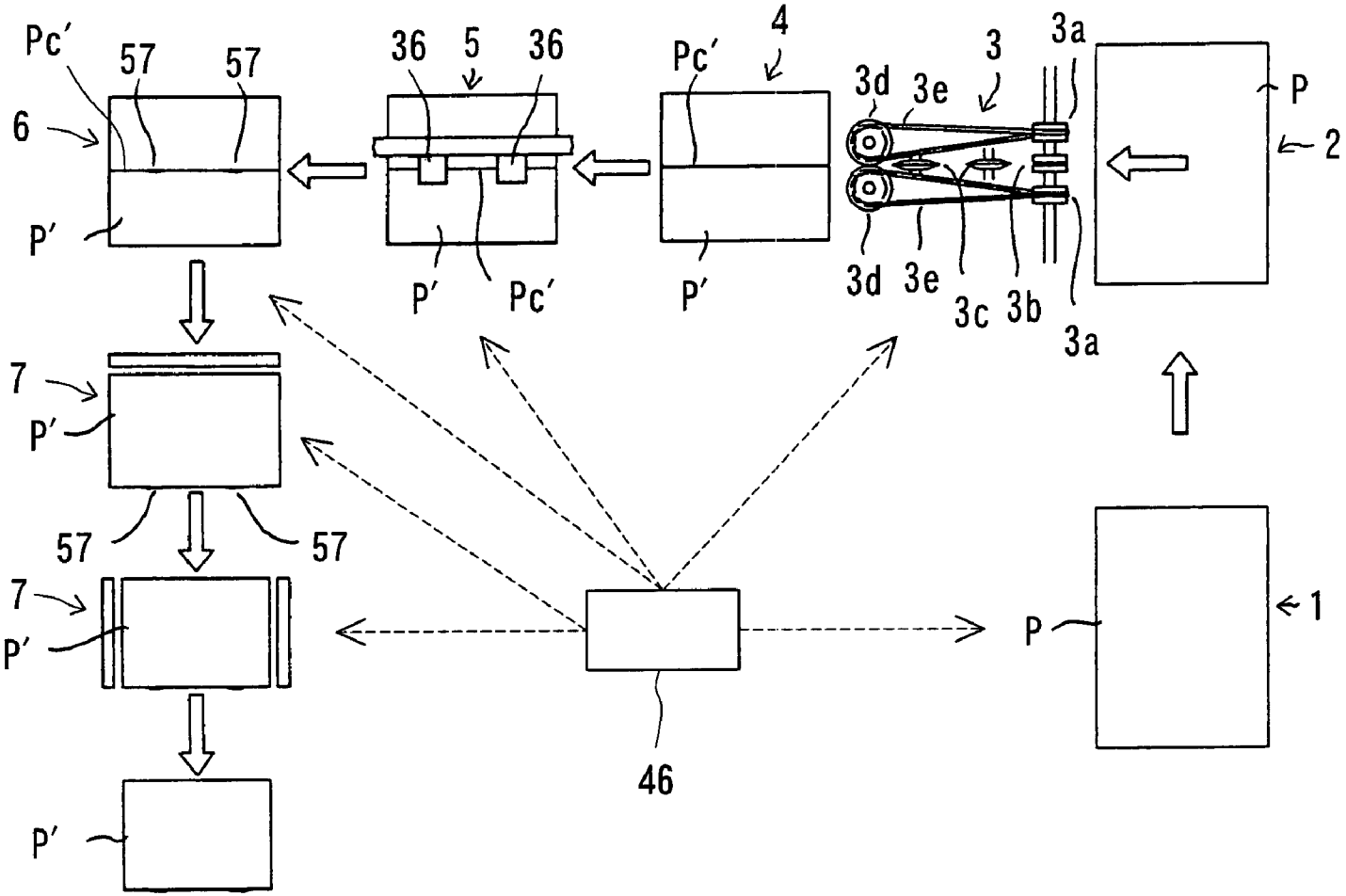
FIG. 2 is a block diagram schematically illustrating a constitution of the book binding system shown in FIG. 1.

Now, the details of the present invention will he described with reference to the accompanying drawings FIG. 1 is a schematic perspective view of a book binding system according to an embodiment of the present invention, and FIG. 2 is a block diagram schematically illustrating a constitution of the book binding system shown in FIG. 1.

Referring to FIGS. 1 and 2, the book binding system of the present invention comprises a sheet feeding section 1 feeding sheets or sets of sheets one by one. In this embodiment, the sheet feeding section 1 is a collating machine adapted to eject a plurality of sets of sheets P which are collated in an order of pages one by one. The collated sheets forming a booklet are ejected from the collating machine 1 in one cycle of operation of the collating machine.

The book binding system of the present invention also comprises a sheet folding section 3 sequentially receiving a set of sheets P from the collating machine 1 and folding the set of sheets P along the center line Pc thereof and a sheet stacking section 4 stacking the set of sheets P folded by the sheet folding section 3 in such a manner that the folded sets of sheets P are aligned with each other with respect to the fold lines Pc thereof.

The book binding system further comprises a sheet stitching section 5 receiving a stack of the sets of sheets P' from the sheet stacking section 4 each time the predetermined number of the sets of sheets P are stacked in the sheet stacking section 4, and stitching the stack of the sets of sheets P' at the fold line thereof Pc', a sheet taking out section 6 receiving the stitched stack of sheets from the sheet stitching section 5 and supplying the stack to a trimming section 7 for trimming a front edge, a top edge and a foot edge of the stack, and a control section 46 controlling operation of the sheet feeding section (collating machine) 1, the sheet folding section 3, the sheet stitching section 5, the sheet taking out section 6 and the trimming section 7.

Figure 3:
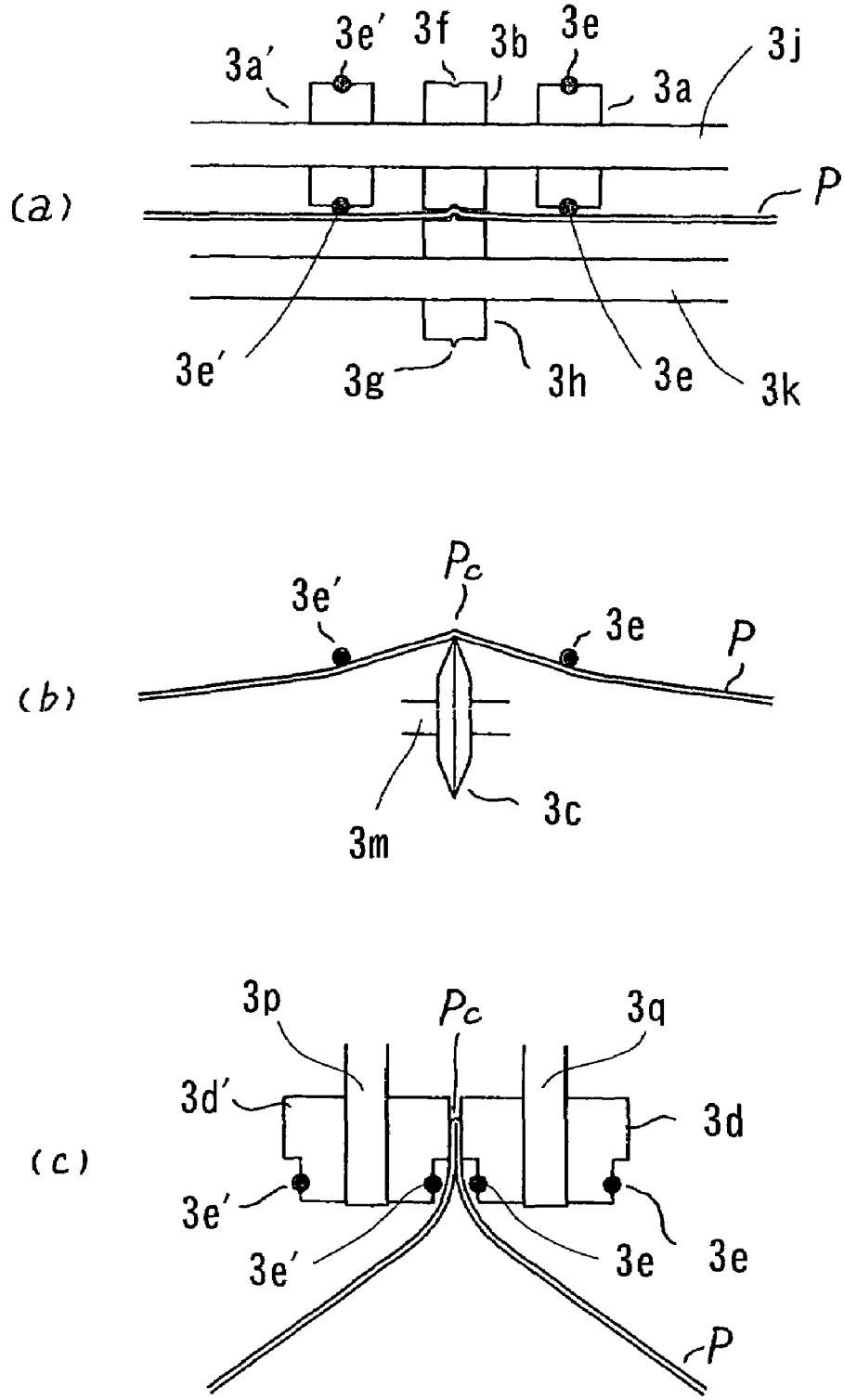
FIG. 3 is an elevational view illustrating a constitution of a sheet folding section of the book binding system shown in FIG. 1.

FIG. 3 is an elevational view illustrating a constitution of the sheet folding section of the book binding system shown in FIG. 1. Referring to FIGS. 1 and 3, the book binding system comprises a frame F and the sheet folding section 3 comprises a sheet positioning table 2 attached to the frame F for sequentially receiving the set of sheets P from the sheet feeding section 1 and positioning the set of sheets P in place. The sheet folding section 3 is also provided with a sheet conveying path extending from the sheet positioning table 2 to the sheet stacking section 4. The sheet positioning table 2 positions the set of sheets P such that the center line of the set of sheets P aligns with the center line of the sheet conveying path.

At the entrance of the sheet feeding section 3, upper and lower horizontal rotating shafts 3*j*, 3*k* are attached to the frame F with the sheet conveying path therebetween and extend in the direction transverse to the sheet conveying path. A motor M3 is attached to the frame F and a pulley 3*s* is fixed to a drive shaft of the motor M3. An endless belt 3*t* extends between the pulley 3*s* and a pulley 3*r* fixed to the upper horizontal rotating shaft 3*j*, so that the upper horizontal rotating shaft 3*j* is rotated by drive of the motor M3. Referring now to FIG. 3(*a*), upper and lower creasing rollers 3*b*, 3*h* are fixed to the upper and lower horizontal rotating shafts 3*j*, 3*k*, respectively. The upper and lower creasing rollers 3*b*, 3*h* are disposed at the position corresponding to the center line of the conveying path and bring their outer periphery surfaces into contact with each other. The upper creasing roller 3*b* is provided with a groove 3*f* extending about its outer periphery and the lower creasing roller 3*h* is provided with a protrusion 3*g* extending about its outer periphery correspondingly with the groove 3*f*. The groove 3*f* and the protrusion 3*g* are disposed at a position corresponding to the center line of the conveying path. Thus the set of sheets P supplied from the sheet feeding section 1 to the sheet positioning table 2 is nipped between the upper and lower creasing rollers 3*b*, 3*h* and provided with an inverted V-shaped fold line thereon.

At a downstream side of the horizontal rotating shafts 3*j*, 3*k* is at least one horizontal support shaft 3*m* attached to the frame F Referring now to FIG. 3(*b*), a guide roller 3*c* is rotatably attached to the at least one horizontal support shaft 3*m* at a position corresponding to the center line of the sheet conveying path. An outer periphery edge of the thereof upwardly pushing the fold line Pc of the set of sheets P traveling on the sheet conveying path.

Referring now to FIG. 3(*c*), a pair of vertical support shafts 3*p*, 3*q* are attached to the frame F at the exit of the sheet folding section 3 and extending downwardly from the frame F across the sheet conveying path at the both sides of the center line of the sheet conveying path, and a pair of press rollers 3*d*, 3*d*'are rotatably attached to the lower ends of the vertical support shafts. Each of the press rollers 3*d*, 3*d*' is composed of a large radius portion and a small radius portion connecting to the underside of the large radius portion, and the press rollers 3*d*, 3*d*' bring their outer periphery surfaces into contact with each other at a position corresponding to the center line of the sheet conveying path. Thus, as shown in FIG. 3(*c*), the set of sheets P is nipped at its peripheral portion Pc folded along the fold line between the press rollers 3*d*, 3*d*' and fed downstream.

Pulleys 3*a*, 3*a*' are fixed to the upper horizontal rotating shaft 3*j* at both sides of the upper creasing roller 3*b*. A first endless belt 3*e* extends between the pulley 3*a* and the small radius portion of the press roller 3*d* at one side of the center line of the sheet conveying path, and a second endless belt 3*c*' extends between the pulley 3*a*' and the small radius portion of the press roller 3*d*' at the other side of the center line of the sheet conveying path. Portions of the first and second endless belts 3*a*, 3*a*' which travel in a feeding direction of the set of sheets P contacting with a top surface of the set of sheets P and gradually narrowing the spacing therebetween towards the exit of the sheet folding section 3 (cf. FIG. 2). Thus the set of sheets P is folded into an inverted V-shape along the center line thereof by being passed between the upper and lower creasing rollers 3*b*, 3*h*, conveyed along the sheet conveying path by the at least one guide roller 3*c* and the first and second endless belts 3*c*, 3*c*' and passed between the pair of press rollers 3*d*, 3*d*'.

The sheet stacking section 4 comprises a saddle-shaped pair of support plates (not shown) attached to the frame at the downstream side of the sheet folding section 3 and extending in a direction of the sheet conveying path of the sheet folding section 3 with a spacing therebetween for supporting the sets of sheets P folded into an inverted V-shape by the sheet folding section 3 thereon.

Figure 4:
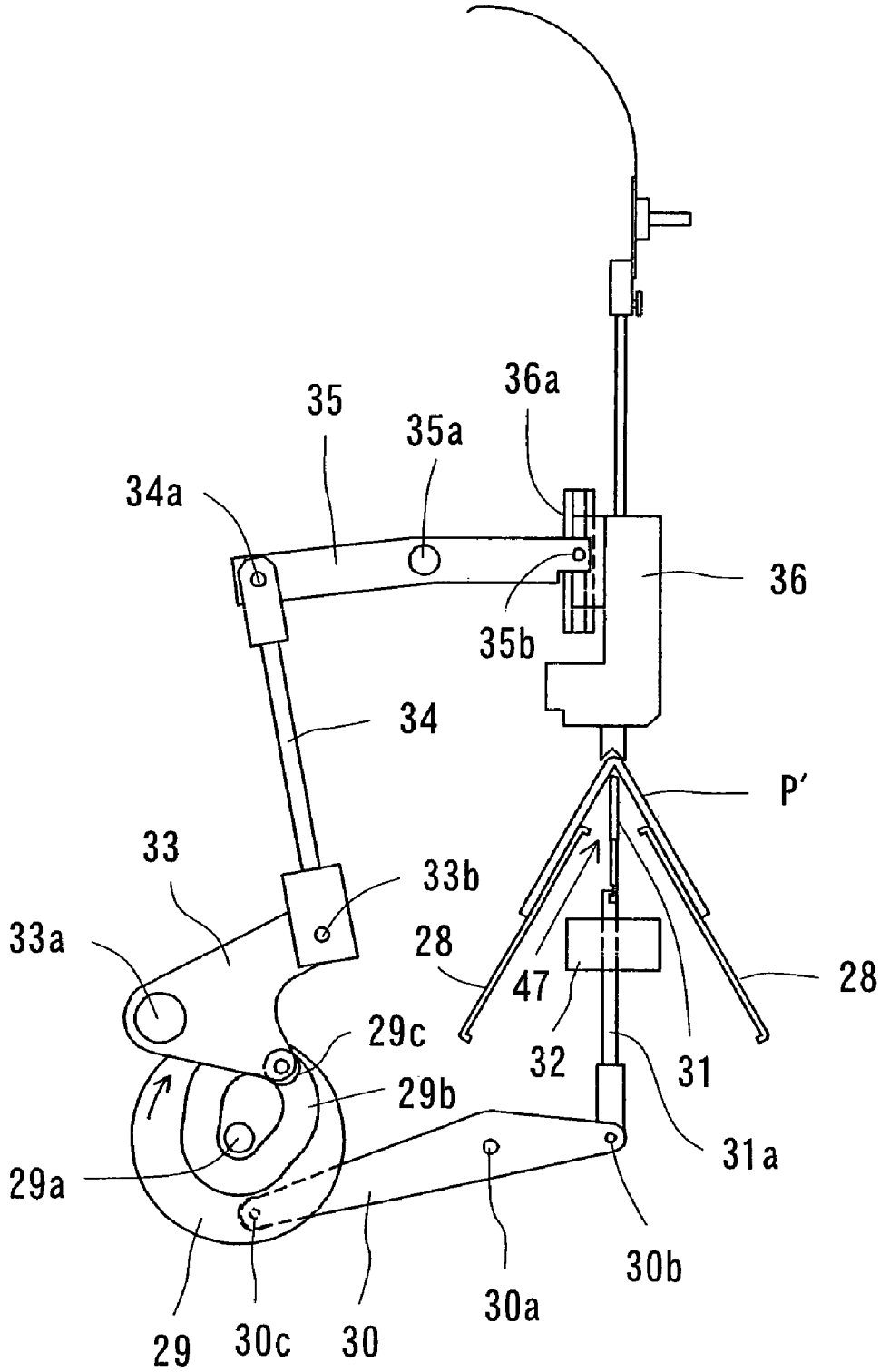
FIG. 4 is an elevational view of a sheet stitching section of the book binding system shown in FIG. 1.

FIG. 4 is an elevational view of the sheet stitching section 5. Referring to FIG. 4, the sheet stitching section 5 comprises a second saddle-shaped pair of support plates 28 connecting to the pair of support plates of the sheet stacking section 4. A sheet stitching station is provided on the second pair of support plates 28.

The sheet stitching section 5 further comprises a sheet conveying mechanism conveying a stack of the sets of sheets P' from the sheet stacking section 4 to the sheet stitching station when the predetermined number of the folded sets of sheets P are stacked in the sheet stacking section 4.

Referring now to FIG. 1, at the sheet stitching station, a stopper 5*a* is attached to the frame F above the second pair of support plates at the sheet stitching station for vertical movement. The stopper 5*a* is movable between a first position in which the stopper 5*a* is retracted upwardly from the sheet stitching station and a second position in which the stopper intrudes into the sheet stitching station for positioning the stack of the sets of sheets P' fed from the sheet stacking section 4 in place by abutment of the leading edge of the stack against the stopper 5*a*. As shown in FIG. 4, a stitching wire drive head 36 is arrange for vertical movement through a guide rail 36*a* fixed to the frame above the top end spacing 47 between the second pair of support plates 28 at the sheet stitching station, so that the stitching wire drive head 36 is movable between a standby position in which the stitching wire drive head 36 separates from the top end spacing 47 and a stitching position (cf. FIG. 4) in which the stitching wire drive head 36 contacts with the stack of the set of sheets P' supported on the second pair of support plates 28 so as to drive the stitching wire 57 into the fold line of the sack P'. In this embodiment, two stitching wire drive head 36 are arranged with spacing therebetween in a direction along the fold line Pc' of the stack P'. A stitching wire bending block 31 is arranged for vertical movement through a guide block 32 fixed to the frame below the top end spacing 47 between the second pair of support plates 28 at the sheet stitching station, so that the stitching wire bending block 31 is movable between a standby position in which the stitching wire bending block 31 separates from the top end spacing 46 between the second pair of support plates 28 and a stitching position (cf. FIG. 4) in which the stitching wire bending block 31 contacts with the stack of the sets of the sheets P' so as to support the stack P' thereon. The sheet stitching section 5 further comprises a drive mechanism for moving the stitching wire drive head 36 and the stitching wire bending block 31 in such a manner that the stitching wire bending block 31 is in its standby position upon the stitching position of the stitching wire drive head 36 and in its standby position upon the standby position of the stitching wire drive head 36. In this embodiment, as shown in FIG. 4, the drive mechanism includes a disc 29 attached to the frame for rotation about a horizontal pivot 29*a* and a crank 33 attached to the frame for swing movement about a horizontal pivot 33*a*. The crank 33 is connected to the disc 29 at one end through a roller 29*c* arranged for slide movement in a groove 29*b* formed on a side of the disc 29. The stitching wire drive head 36 is connected to one end of a lever 35 through a pin 35*b* and the lever 35 is attached to the frame for swing movement about a horizontal pivot 35*a*. To the other end of the crank 33, a link 34 is pivotally connected at its one end through a pin 33*b* and the other end of the link 34 is pivotally connected to the other end of the lever 35 through a pin 34*a*. The stitching wire bending block 31 is fixed to the upper end of a vertical rod 31*a* which is arranged for vertical movement through a guide block 32 attached to the frame. A lever 30 is attached to the frame for swing movement about a horizontal pivot 30*a* and one end of the lever 30 is pivotally connected to the lower end of the rod 31*a* through a pin 30*b*. The other end of the lever 30 is pivotally connected to the other side of the disc 29. Thus the stitching wire drive head 36 and the stitching wire bending block 31 are upwardly and downwardly moved in the direction opposite to each other with rotation of the disc 29, so that the stitching wire bending block 31 is in its stitching position upon the stitching position of the stitching wire drive head 36 and in its standby position upon the standby position of the stitching wire drive head 36.

Figure 5:
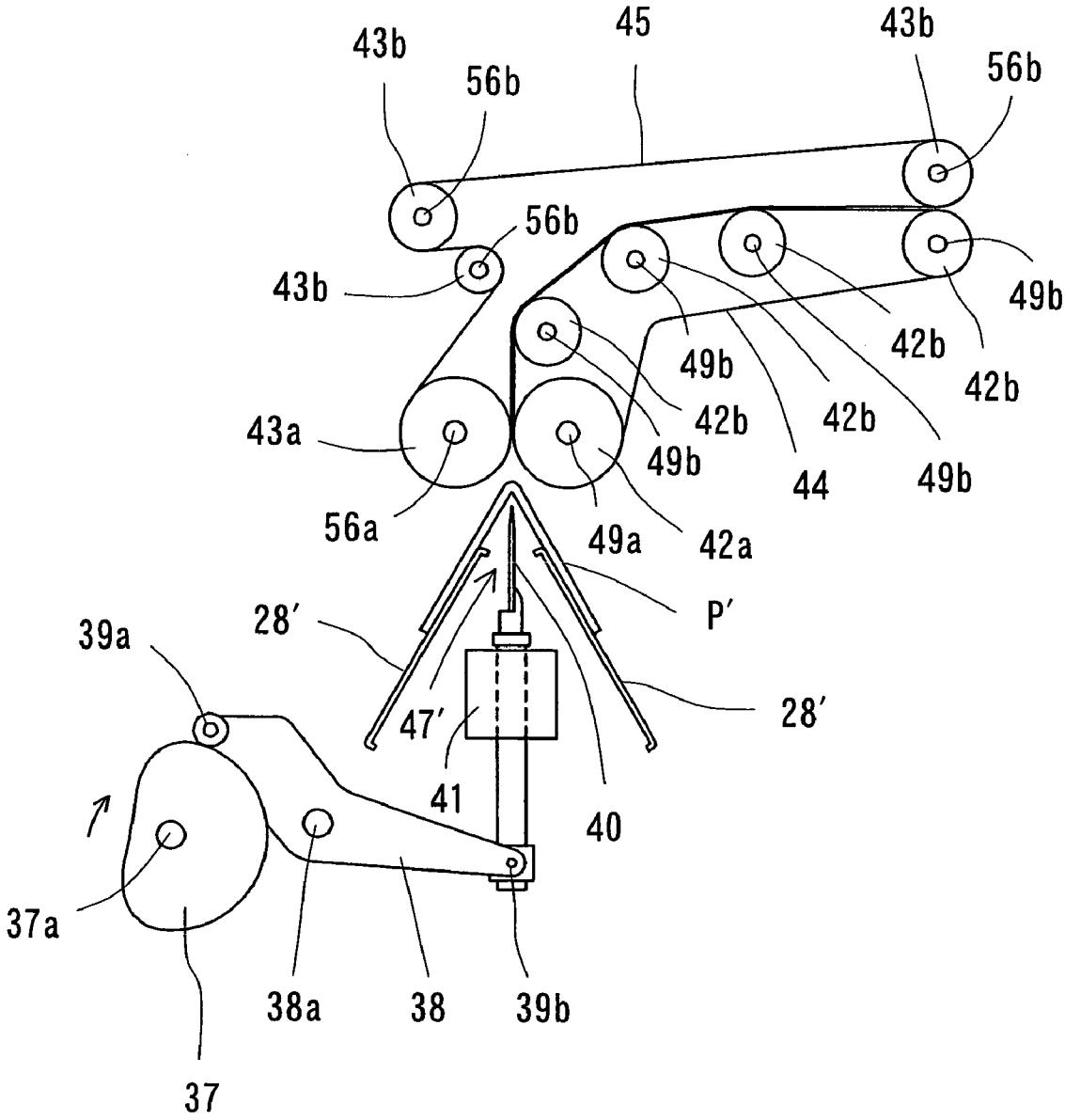
FIG. 5 is an elevational view of a sheet taking out section of the book binding system shown in FIG. 1.

FIG. 5 is an elevational view of the sheet taking out section 6. As shown in FIG. 5, the sheet taking out section 6 comprises a third saddle-shaped pair of support plate 28' connecting to the pair of support plates 28 of the sheet stitching section 5. The sheet taking out station is provided on the third pair of support plates 28'.

The sheet taking out section 6 further comprises a sheet conveying mechanism conveying a stack of the sets of sheets P' from the sheet stitching section 5 to the sheet taking out station after the stacks of the sets of sheets was saddle-stitched.

In this embodiment, the sheet conveying mechanism of the sheet stitching section 5 and the sheet taking out section 6 is a common sheet conveying mechanism. Referring now to FIG. 1, the common sheet conveying mechanism comprises a motor M1 attached to the frame F and having a horizontal drive shaft 48. An index unit 11 is attached to the frame and provided with a horizontal input rotary shaft 11*a* and a horizontal output rotary shaft 11*b*. The index unit 11 is adapted to halt rotation of the output rotary shaft 11*b* for the predetermined time duration of rotation of the input rotary shaft 11*a*. The input rotary shaft 11*a* is operatively connected to the drive shaft 48 of the motor M1 through a clutch/brake unit and an endless belt 48*a*. At least one drive sprocket 16*a* is fixed to the output rotary shaft 11*b* of the index unit 11. The sheet conveying mechanism further comprises at least one horizontal sprocket support shaft 16*c* fixed to the frame and at least one idle sprocket 16*b* rotatably attached to the sprocket support shaft 16*c*. At least one endless chain 8 extends among the drive and idle sprockets 16*a*, 16*b* in a vertical plane in such a manner that the upper linear portion of the endless chain 8 traveling along the top end spacing 47, 47' of the support plate pairs of both the sheet stacking section 4, the sheet stitching section 5 and the sheet taking out section 6. In this case, by means of the index unit 11, the at least one endless chain 8 is intermittently circulated. At least one conveying claw 9 is fixed to the at least one endless chain 8. Thus the stack of the sets of sheets P' are conveyed along the support plate pairs of the sheet stacking section 4, the second support plate pairs 28 of the sheet stitching section 5 and the third support plate pairs 28' of the sheet taking out section 6 by the conveying claw 9 pushing a trailing edge of the stack P' with circulating of the at least one endless chain 8. A stopper (not shown) is arranged at the downstream side of the sheet taking out station for positioning the stack of the sets of sheets by abutment with the leading end of the stack conveyed.

Referring to FIG. 5 again, at the sheet taking out station, a sheet folding knife 40 is arranged for vertical movement through a slide guide block 41 fixed to the frame below the top end spacing 47' between the third pair of support plates 28', so that the sheet folding knife 40 is movable between a standby position in which the sheet folding knife 40 separates from the top end spacing 47' and a sheet folding position (cf. FIG. 5) in which the sheet folding knife 40 sticks out upwardly from the top end spacing 47' so as to upwardly push the fold line Pc' of the stack P'. The sheet taking out section 6 further comprises a cam 37 attached to the frame for rotation about a horizontal pivot 37*a* and a lever 38 attached to the frame for swing movement about a horizontal pivot 38*a* having a cam follower 39*a* at its one end. The other end of the lever 38 is pivotally connected to the lower end of the sheet folding knife 40. So the sheet folding knife 40 is moved in a vertical direction between its standby position and its sheet folding position as the cam 37 is rotated. At a position according to the fold line Pc' of the stack P' supported on the pair of support plates 28', a pair of drive rollers 42*a* and 43*a* are arranged for rotation about horizontal drive shafts 49*a*, 56*a* thereof supported by the frame such that they extend in a conveying direction of the stack P'. Two sets of horizontal idle rollers 42*a*, 43*a* are arranged for rotation about horizontal shafts 49*b* and 56*b* attached to the frame above the pair of drive rollers 42*a*, 43*a*. A first endless belt 44 extends among one sets of the idle rollers 42*b* as well as the drive roller 42*a* and a second endless belt 45 extends among the other set of the idle rollers 43*b* as well as the drive roller 43*a*. The portions of the endless belts 44, 45 traveling in a direction away from the sheet taking out station contact with each other, and thereby the saddle-stitched stack P' lifted by the sheet folding knife 40 in the sheet taking out station is nipped and passed between the portions of the endless belts 44, 45 in a direction perpendicular to the conveying direction of the sheet folding section 3, the sheet stacking section 4 and the sheet stitching section 5, and fed into the trimming section 7.

The stitched stack of the sets of sheets P' supplied to the trimming section 7 is firstly trimmed by a front edge trimming cutter 7*a* at its front edge and thereafter trimmed by a top and foot edge trimming cutter 7*b* at its top and foot edges.

The trimming section 7 comprises a motor M2 attached to the frame F, a drive shaft 17 attached to the frame for rotation about its axis and connected to a rotary shaft of a motor M2 through an endless chain, a crank plate 18 fixed to an end of the drive shaft 17, a front edge trimming cutter 7*a* connected to the crank plate 18 for vertical movement. The trimming section 7 further comprises a drive shaft 21 attached to the frame for rotation about its axis and connected to the drive shaft 17 through an endless chain 24 in such a manner that the drive shaft 21 is rotated synchronously with rotation of the drive shaft 17, a crank plate 22 fixed to an end of the drive shaft 21, a top and foot edge trimming cutter 7*b*, 7*c* connected to the crank plate 22 for vertical movement. The drive shaft 17 is provided with a disc having an extension strip 23*a* at its outer periphery and a pulse plate 19 generating a pulse every time it rotates a given amount of angle. The trimming section 7 further comprises an initial position sensor 23 for detecting an initial position of the front edge trimming cutter 7*a* by detecting the extension strip 23*a* of the disc and an encoder 20 for counting pulses generated by the pulse plate after detection of the extension strip 23*b* by the initial position sensor 23 so as to determine a position of the front edge trimming cutter 7*a*.

Figure 6:
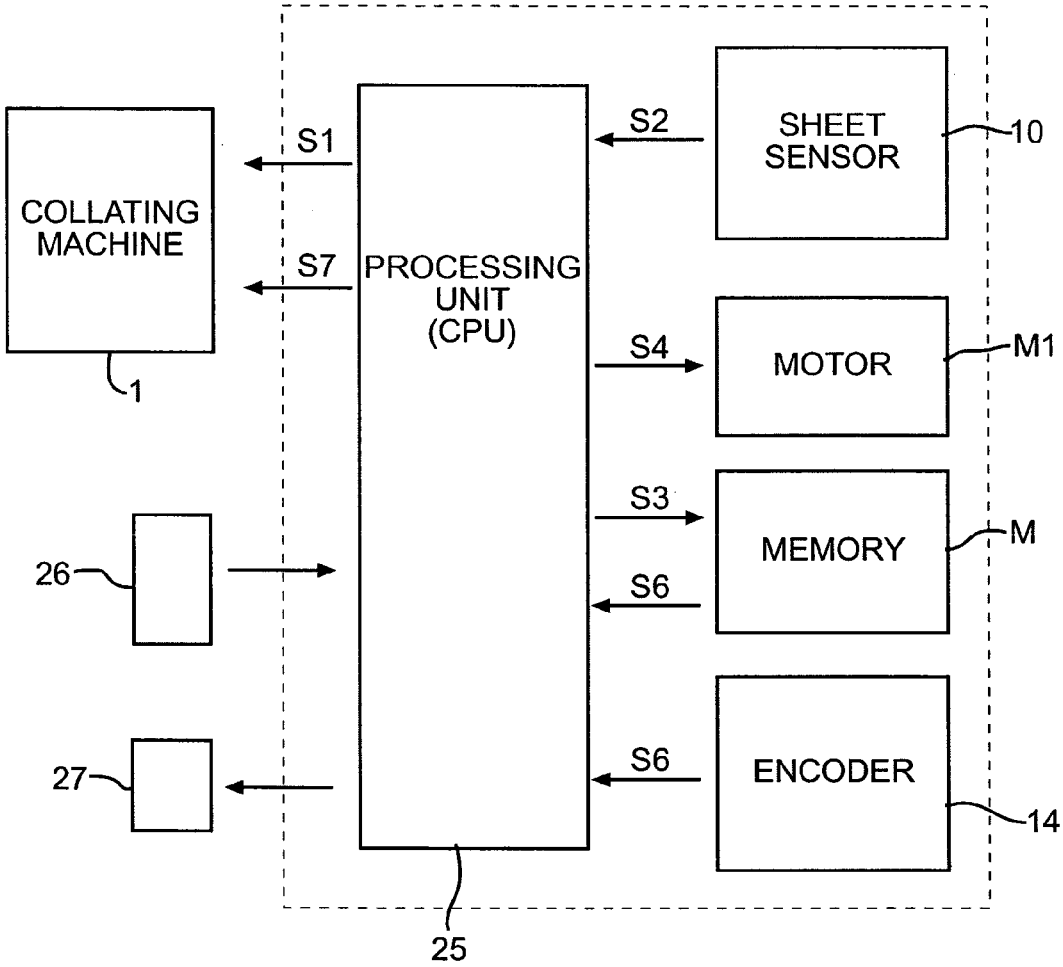
FIG. 6 is a block diagram schematically illustrating a constitution of a part of a control section of the book binding system shown in FIG. 1, the part of the control section which controls operation of a sheet feeding section, a sheet folding section and a sheet stitching section.
Figure 7:
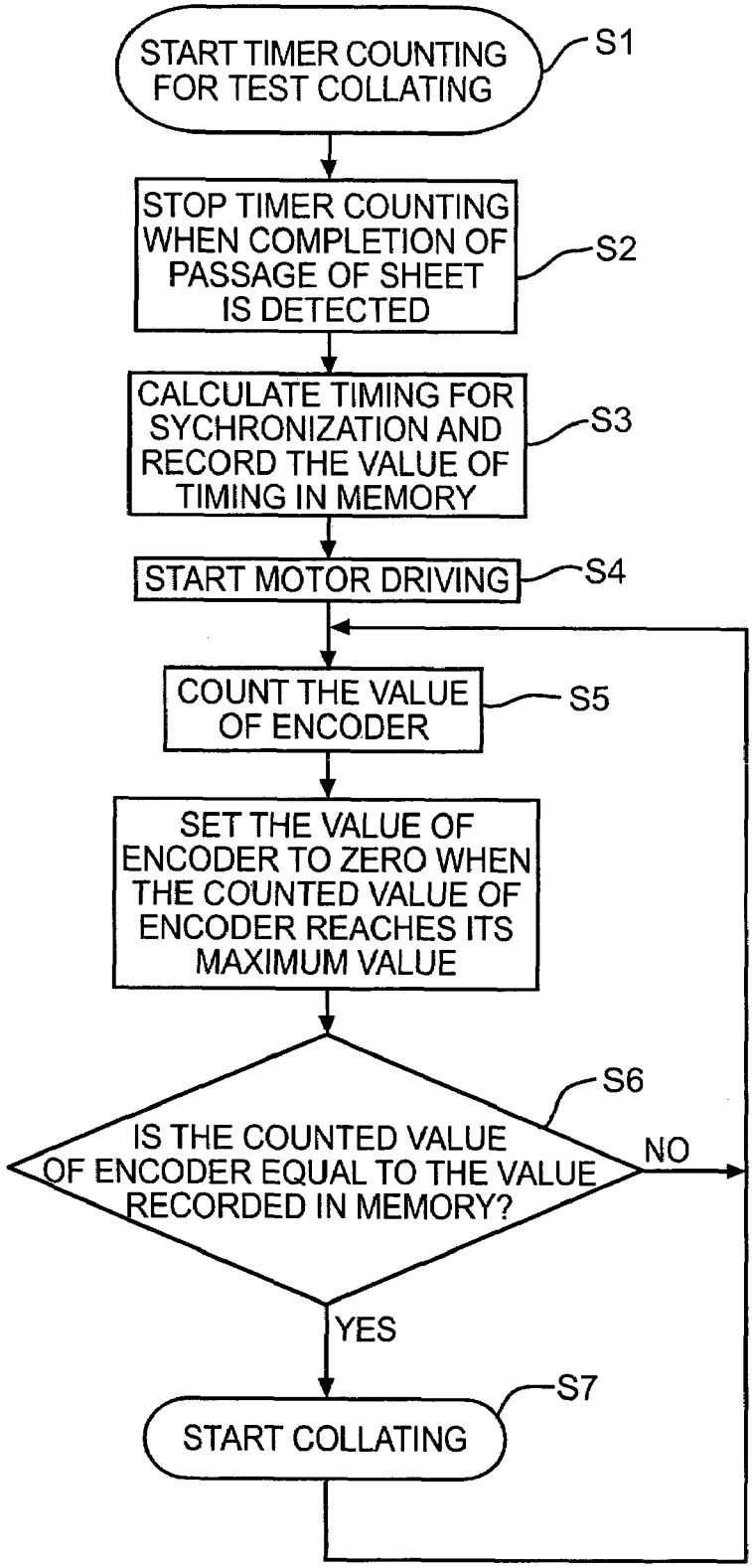
FIG. 7 is a flow chart of operation of the part of the control section shown in FIG. 6.
Figure 8:
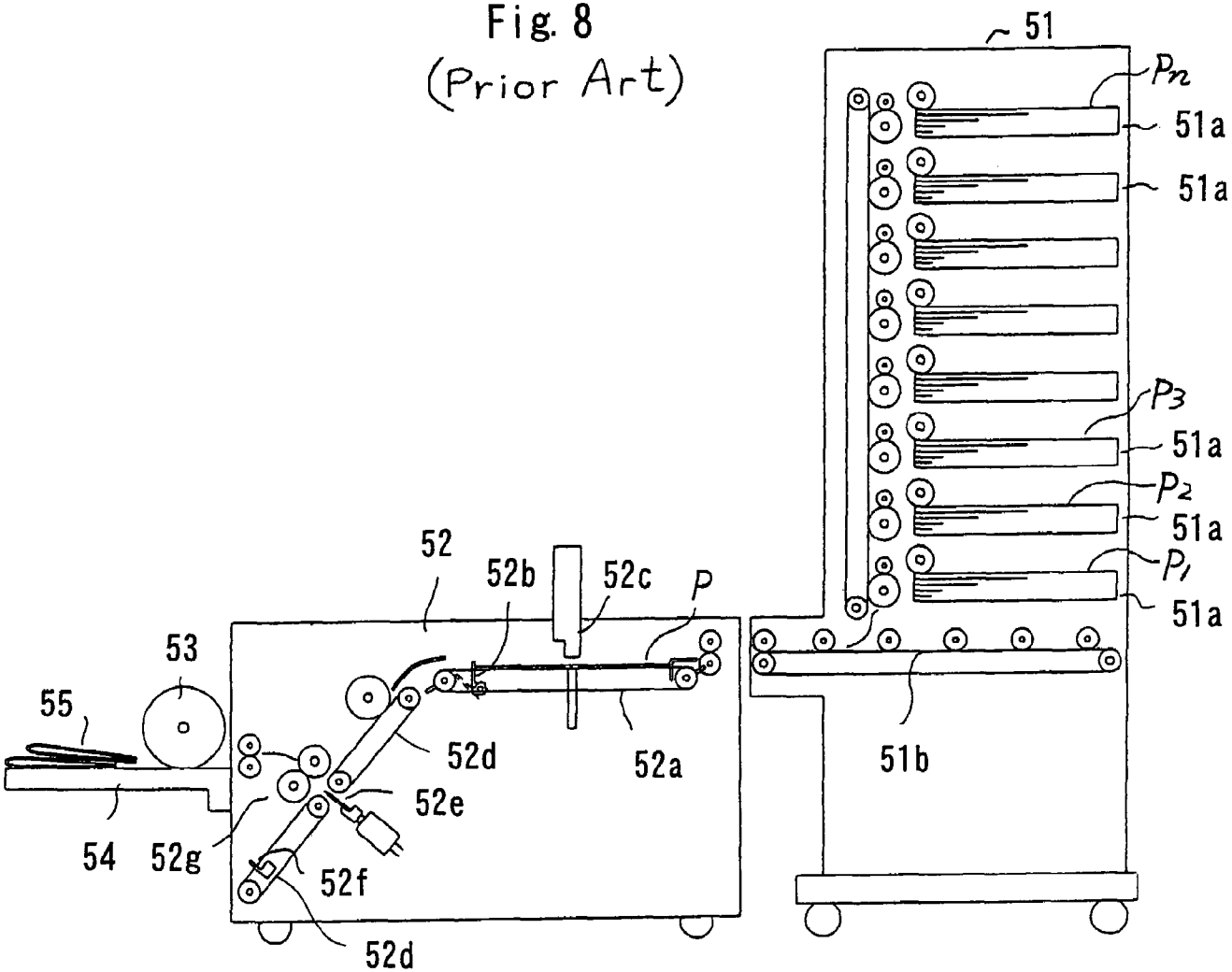
Fig. 8 (Prior Art)
FIG. 8 is a front view schematically illustrating a constitution of a conventional saddle stitching bookbinding system

FIG. 6 is a block diagram schematically illustrating a constitution of a part of a control section of the book binding system shown in FIG. 1, the part of the control section which controls operation of a sheet feeding section, a sheet folding section and a sheet stitching section, and FIG. 7 is a flow chart of operation of the part of the control section shown in FIG. 6.

In control of operation of the sheet feeding section 1, the sheet folding section 3 and the sheet stitching section 5, the control section 46 measures time from start up of operation of the sheet feeding section 1 to stacking of the predetermined number of the sets of sheets P in the sheet stacking section 4 so as to determine the timing of operation of the sheet stitching section 5 and record a value of the determined timing upon pre operation of the system, and measures time elapsed from reception of the stack P' by the sheet stitching section 5 and sends a start up signal of operation to the sheet feeding section 1 each time the measured time equals to the recorded value of the timing in operation of the system. Referring to FIGS. 1 and 6, the control section 46 comprises a sheet sensor 10 disposed between the sheet folding section 3 and the sheet stacking section 4 for detecting passage of the predetermined number of the sets of sheets P'. In this embodiment, the sheet sensor 10 is a light-transmission type sensor having a reflector 10*a*, but a light-reflection type sensor may be employed alternatively. The control section 46 further comprises a subsidiary rotary shaft 13*a* coaxially coupled to the input rotary shaft 11*a* of the index unit 11, a pulse plate 13 fixed to the subsidiary rotary shaft 11*a* for generating a pulse every time it rotates a given amount of angle and an encoder 14 for counting pulses generated by the pulse plate. A disc 15*b* is fixed to the subsidiary rotary shaft 13*a* and has a extension strip 15*a* at its periphery. An initial position sensor 15 is arranged for detecting an initial position of the conveying claw 9 of the sheet conveying mechanism of the sheet stitching section 5 in which the conveying claw 9 is positioned at an upstream side of the sheet stacking section 4 (in this embodiment, at the same instant, an initial position of the conveying claw 9 in which the conveying claw 9 is positioned at a downstream side of the sheet stitching section 5) by detecting the extension strip 15*a* of the disc 15. The control section 46 further comprises a processing unit 25, a memory M, an input unit 26 for receiving an input of data and a display unit 27.

In pre-operation of the system, at first, the processing unit 25 brings the stitching section 5 to a halt and sends a start up signal of operation to the sheet feeding section (the collating machine) 1 and starts operation of time counter (FIG. 7, step S1) and stops operation of timer counter when the completion of passage of the predetermined number of the sets of sheets is detected by the sheet sensor 10 (FIG. 7, step S2). Thus the processing unit 25 measures time from start up of operation of the sheet feeding section 1 to stacking of the predetermined number of the sheets or the sets of sheets in the sheet stacking section 4. Then the processing unit 25 determines the timing of operation of the sheet stitching section 5 and records a value of the determined timing in the memory M (FIG. 7, step S3).

Thereafter, the processing unit 25 gets the sheet stitching section 5 started by initiating drive of the motor M1 so as to be the system in operation (FIG. 7, step S4). The processing unit 25 measures time elapsed from reception of the stack P' by the sheet stitching section 5 based on the counted value of the encoder (FIG. 7, S5), and sends a start up signal of operation to the sheet feeding section 1 each time the measured time equals to the recorded value of the timing in operation of the system (FIG. 7, steps S6 and S7). Consequently, the stacking operation is started in the sheet stacking section 4 each time one of the conveying claw 9 is positioned at its initial position at the upstream side of the sheet stacking section 4.

In the above-mentioned embodiment, the sheet stitching section 5 and the sheet taking out section 6 are intermittently moved, but the present invention can be applied to a system in which the sheet stitching section 5 and the sheet taking out section 6 are continuously moved.

As described above, according to the present invention, it is possible to obtain the advantages that a saddle-stitched bound booklet with a near fold line and good appearance can be manufactured by separating a stack of sheets which forms a booklet into a plurality of sets of sheets accordingly with the number of sheets of the stack, separately folding the sets of sheets along the center line thereof, stacking the folded sets of sheets and stitching the stack of the sets of sheets along the center line thereof. In addition, there is provided a book binding system capable of optimally synchronize a motion of post-processing machine with a motion of a collator so as to increase the processing speed of book binding.

While the embodiment disclosed herein is preferred, it will be appreciated from this teaching that various alternatives, modifications, variations or improvements therein may be made by those skilled in the art, which are intended to be encompassed by the following claims.

What is claimed is:

1. A book binding system for a saddle-stitched bound booklet, comprising:

a sheet feeding section feeding sheets or sets of sheets one by one;

a sheet folding section sequentially receiving a sheet or a set of sheets from the sheet feeding section and folding the sheet or the set of sheets along the center line thereof;

a sheet stacking section stacking the sheet or the set of sheets folded by the sheet folding section in such a manner that the folded sheets or the folded sets of sheets are aligned with each other with respect to the fold lines thereof;

a sheet stitching section receiving a stack of the sheets or the sets of sheets from the sheet stacking section each time the predetermined number of the sheets or the sets of sheets are stacked in the sheet stacking section, and stitching the stack of the sheets or the sets of sheets at the fold line thereof; and the sheet folding section further comprising:

a sheet positioning means for sequentially receiving the sheet or the set of sheets from the sheet feeding section and positioning the sheet or the set of sheets in place;

a sheet conveying path extending from the sheet positioning means to the sheet stacking section, the sheet positioning means positioning the sheet or the set of sheets in such a manner that the center line of the sheet or the set of sheets aligns with the center line of the sheet conveying path;

a fold line forming means arranged at the entrance of the sheet conveying path for forming an inverted V-shaped fold line on the sheet or the set of sheets along the center line thereof while conveying the sheet or the set of sheets; and a folding means arranged at the downstream side of the fold line forming means for folding the sheet of the set of sheets along the fold line while conveying the sheet or the set of sheets received from the fold line forming means;

a control section controlling operation of the sheet feeding section, the sheet folding section and the sheet stitching section;

a frame; and the sheet positioning means of the sheet folding section comprising:

a sheet positioning table attached to the frame for sequentially receiving the sheet or the set of sheets from the sheet feeding section and positioning the sheet or the set of sheets in place;

the fold line forming means of the sheet folding section further comprising:

upper and lower horizontal rotating shafts attached to the frame at the entrance of the sheet conveying path so as to be arranged one above the other with the sheet conveying path therebetween and extending in the direction transverse to the sheet conveying path;

a drive mechanism attached to the frame for rotating the upper horizontal rotating shaft;

upper and lower creasing rollers fixed to the upper and lower horizontal rotating shafts, respectively, the upper and lower creasing rollers being disposed at the position corresponding to the center line of the conveying path and bringing their outer periphery surfaces into contact with each other, the upper creasing roller being provided with a groove extending about the outer periphery thereof, the lower creasing roller being provided with a protrusion extending about the outer periphery thereof correspondingly with the groove, the groove and the protrusion being disposed at a position corresponding to the center line of the conveying path, the sheet or the set of sheets on the sheet positioning table being nipped between the upper and lower creasing rollers and provided with an inverted V-shaped fold line thereon;

at least one horizontal support shaft attached to the frame at a downstream side of the horizontal rotating shafts;

a guide roller rotatably attached to the at least one horizontal support shaft at a position corresponding to the center line of the sheet conveying path, an outer periphery edge thereof upwardly pushing the fold line of the sheet or the set of sheets traveling on the sheet conveying path;

the folding means of the sheet folding section further comprising:

a pair of vertical support shafts attached to the frame at the exit of the sheet conveying path and extending downwardly from the frame across the sheet conveying path at the both sides of the center line of the sheet conveying path;

a pair of press rollers rotatably attached to the lower ends of the vertical support shafts, each of the press rollers being composed of a large radius portion and a small radius portion connecting to the underside of the large radius portion, the press rollers bringing their outer periphery surfaces into contact with each other at a position corresponding to the center line of the sheet conveying path, the sheet or the set of sheets being nipped at its peripheral portion folded along the fold line between the press rollers and fed downstream;

pulleys fixed to the upper horizontal rotating shaft at both sides of the upper creasing roller; and a first endless belt extending between the pulley and the small radius portion of the press roller at one side of the center line of the sheet conveying path, and a second endless belt extending between the pulley and the small radius portion of the press roller at the other side of the center line of the sheet conveying path, portions of the first and second endless belts which travel in a feeding direction of the sheet or the set of sheets contacting with a top surface of the sheet or the set of sheets and gradually narrowing the spacing therebetween towards the exit of the sheet folding section;

whereby the sheet or the set of sheets is folded into an inverted V-shape along the center line thereof by being passed between the upper and lower creasing rollers, conveyed along the sheet conveying path by the at least one guide roller and the first and second endless belts and passed between the pair of press rollers.

2. The book binding system according to claim 1, wherein the sheet stacking section comprises:

a saddle-shaped pair of support plates attached to the frame at the downstream side of the sheet folding section and extending in a direction of the sheet conveying path of the sheet folding section with a spacing therebetween for supporting the sheets or the sets of sheets folded into an inverted V-shape by the sheet folding section thereon;

the sheet stitching section comprises:

a second saddle-shaped pair of support plates connecting to the pair of support plates of the sheet stacking section;

a sheet stitching station provided on the second pair of support plates;

a sheet conveying mechanism conveying a stack of the sheets or the sets of sheets from the sheet stacking section to the sheet stitching station when the predetermined number of the folded sheets or the folded sets of sheets are stacked in the sheet stacking section;

a stopper attached to the frame above the second pair of support plates at the sheet stitching station for positioning the stack of the sheets or the sets of sheets fed by the sheet conveying mechanism in place;

a stitching wire drive head attached to the frame above the top end spacing between the second pair of support plates at the sheet stitching station for vertical movement, the stitching wire drive head being movable between a standby position in which the stitching wire drive head separates from the top end spacing and a stitching position in which the stitching wire drive head contacts with the stack of the sheets or the set of sheets supported on the second pair of support plates so as to drive the stitching wire into the fold line of the stack;

a stitching wire bending block attached to the frame below the top end spacing between the second pair of support plates at the sheet stitching station for vertical movement, the stitching wire bending block being movable between a standby position in which the stitching wire bending block separates from the top end spacing between the second pair of support plates and a stitching position in which the stitching wire bending block contacts with the stack of the sheets or the sets of the sheets so as to support the stack thereon; and a drive mechanism for moving the stitching wire drive head and the stitching wire bending block in such a manner that the stitching wire bending block is in its stitching position upon the stitching position of the stitching wire drive head and in its standby position upon the standby position of the stitching wire drive head.

3. The book binding system according to claim 2, wherein the sheet conveying mechanism of the sheet stitching section comprises:

a motor attached to the frame and having a horizontal drive shaft;

an index unit attached to the frame and having a horizontal input rotary shaft and a horizontal output rotary shaft, the index unit being adapted to halt rotation of the output rotary shaft for the predetermined time duration of rotation of the input rotary shaft, the input rotary shaft being operatively connected to the drive shaft of the motor through a clutch/brake unit;

at least one drive sprocket fixed to the output rotary shaft of the index unit;

at least one horizontal sprocket support shaft fixed to the frame;

at least one idle sprocket rotatably attached to the sprocket support shaft;

at least one endless chain extending among the drive and idle sprockets in a vertical plane, the upper linear portion of the endless chain traveling along the top end spacing of the support plate pairs of both the sheet stacking section and the sheet stitching section; and a conveying claw fixed to the at least one endless chain;

whereby the stack of the sheets or the sets of sheets are conveyed along the support plate pairs of the sheet stacking section and the sheet stitching section by the conveying claw pushing a trailing edge of the stack with circulating of the at least one endless chain.

4. The book binding system according to claim 3, wherein the control section measures time from start up of operation of the sheet feeding section to stacking of the predetermined number of the sheets or the sets of sheets in the sheet stacking section so as to determine the timing of operation of the sheet stitching section and record a value of the determined timing upon pre-operation of the system, and measures time elapsed from reception of the stack by the sheet stitching section and sends a start up signal of operation to the sheet feeding section each time the measured time equals to the recorded value of the timing in operation of the system.

5. The book binding system according to claim 3, wherein the control section comprises;

a sheet sensor disposed between the sheet folding section and a sheet stacking section for detecting passage of the predetermined number of the sheets or the sets of sheets;

a subsidiary rotary shaft coaxially coupled to the input rotary shaft of the index unit;

a pulse plate fixed to the subsidiary rotary shaft for generating a pulse every time it rotates a given amount of angle;

an encoder for counting pulses generated by the pulse plate;

a disc fixed to the subsidiary rotary shaft and having an extension strip at its periphery;

an initial position sensor for detecting an initial position of the conveying craw of the sheet conveying mechanism of the sheet stitching section in which the conveying claw is positioned at an upstream side of the sheet stacking section by detecting the extension strip of the disc; and a processing unit measuring time from start up of operation of the sheet feeding section to stacking of the predetermined number of the sheets or the sets of sheets in the sheet stacking section based on a detection signal from the sheet sensor so as to determine the timing of operation of the sheet stitching section and record a value of the determined timing in a memory upon pre-operation of the system, and measuring time elapsed from reception of the stack by the sheet stitching section based on the counted value of the encoder, and sending a start up signal of operation to the sheet feeding section each time the measured time equals to the recorded value of the timing in operation of the system.

6. The book binding system according to claim 2, wherein the control section measures time from start up of operation of the sheet feeding section to stacking of the predetermined number of the sheets or the sets of sheets in the sheet stacking section so as to determine the timing of operation of the sheet stitching section and record a value of the determined timing upon pre-operation of the system, and measures time elapsed from reception of the stack by the sheet stitching section and sends a start up signal of operation to the sheet feeding section each time the measured time equals to the recorded value of the timing in operation of the system.

7. The book binding system according to claim 2, wherein the control section comprises;

a sheet sensor disposed between the sheet folding section and a sheet stacking section for detecting passage of the predetermined number of the sheets or the sets of sheets;

a subsidiary rotary shaft coaxially coupled to the input rotary shaft of the index unit;

a pulse plate fixed to the subsidiary rotary shaft for generating a pulse every time it rotates a given amount of angle;

an encoder for counting pulses generated by the pulse plate;

a disc fixed to the subsidiary rotary shaft and having an extension strip at its periphery;

an initial position sensor for detecting an initial position of the conveying craw of the sheet conveying mechanism of the sheet stitching section in which the conveying claw is positioned at an upstream side of the sheet stacking section by detecting the extension strip of the disc; and a processing unit measuring time from start up of operation of the sheet feeding section to stacking of the predetermined number of the sheets or the sets of sheets in the sheet stacking section based on a detection signal from the sheet sensor so as to determine the timing of operation of the sheet stitching section and record a value of the determined timing in a memory upon pre-operation of the system, and measuring time elapsed from reception of the stack by the sheet stitching section based on the counted value of the encoder, and sending a start up signal of operation to the sheet feeding section each time the measured time equals to the recorded value of the timing in operation of the system.

8. The book binding system according to claim 1, wherein the control section measures time from start up of operation of the sheet feeding section to stacking of the predetermined number of the sheets or the sets of sheets in the sheet stacking section so as to determine the timing of operation of the sheet stitching section and record a value of the determined timing upon pre-operation of the system, and measures time elapsed from reception of the stack by the sheet stitching section and sends a start up signal of operation to the sheet feeding section each time the measured time equals to the recorded value of the timing in operation of the system.

9. The book binding system according to claim 1, wherein the control section comprises;

a sheet sensor disposed between the sheet folding section and a sheet stacking section for detecting passage of the predetermined number of the sheets or the sets of sheets;

a subsidiary rotary shaft coaxially coupled to the input rotary shaft of the index unit;

a pulse plate fixed to the subsidiary rotary shaft for generating a pulse every time it rotates a given amount of angle;

an encoder for counting pulses generated by the pulse plate;

a disc fixed to the subsidiary rotary shaft and having an extension strip at its periphery;

an initial position sensor for detecting an initial position of the conveying craw of the sheet conveying mechanism of the sheet stitching section in which the conveying claw is positioned at an upstream side of the sheet stacking section by detecting the extension strip of the disc; and a processing unit measuring time from start up of operation of the sheet feeding section to stacking of the predetermined number of the sheets or the sets of sheets in the sheet stacking section based on a detection signal from the sheet sensor so as to determine the timing of operation of the sheet stitching section and record a value of the determined timing in a memory upon pre-operation of the system, and measuring time elapsed from reception of the stack by the sheet stitching section based on the counted value of the encoder, and sending a start up signal of operation to the sheet feeding section each time the measured time equals to the recorded value of the timing in operation of the system.

10. A book binding system for a saddle-stitched bound booklet, comprising:

a sheet feeding section feeding sheets or sets of sheets one by one;

a sheet folding section sequentially receiving a sheet or a set of sheets from the sheet feeding section and folding the sheet or the set of sheets along the center line thereof;

a sheet stacking section stacking the sheet or the set of sheets folded by the sheet folding section in such a manner that the folded sheets or the folded sets of sheets are aligned with each other with respect to the fold lines thereof;

a sheet stitching section receiving a stack of the sheets or the sets of sheets from the sheet stacking section each time the predetermined number of the sheets or the sets of sheets are stacked in the sheet stacking section, and stitching the stack of the sheets or the sets of sheets at the fold line thereof; and the sheet folding section further comprising:

a sheet positioning means for sequentially receiving the sheet or the set of sheets from the sheet feeding section and positioning the sheet or the set of sheets in place;

a sheet conveying path extending from the sheet positioning means to the sheet stacking section, the sheet positioning means positioning the sheet or the set of sheets in such a manner that the center line of the sheet or the set of sheets aligns with the center line of the sheet conveying path;

a fold line forming means arranged at the entrance of the sheet conveying path for forming an inverted V-shaped fold line on the sheet or the set of sheets along the center line thereof while conveying the sheet or the set of sheets; and a folding means arranged at the downstream side of the fold line forming means for folding the sheet of the set of sheets along the fold line while conveying the sheet or the set of sheets received from the fold line forming means;

a control section controlling operation of the sheet feeding section, the sheet folding section and the sheet stitching section, the control section comprising:

a sheet sensor disposed between the sheet folding section and a sheet stacking section for detecting passage of the predetermined number of the sheets or the sets of sheets;

a subsidiary rotary shaft coaxially coupled to the input rotary shaft of the index unit;

a pulse plate fixed to the subsidiary rotary shaft for generating a pulse every time it rotates a given amount of angle;

an encoder for counting pulses generated by the pulse plate;

a disc fixed to the subsidiary rotary shaft and having an extension strip at its periphery;

an initial position sensor for detecting an initial position of the conveying craw of the sheet conveying mechanism of the sheet stitching section in which the conveying claw is positioned at an upstream side of the sheet stacking section by detecting the extension strip of the disc; and a processing unit measuring time from start up of operation of the sheet feeding section to stacking of the predetermined number of the sheets or the sets of sheets in the sheet stacking section based on a detection signal from the sheet sensor so as to determine the timing of operation of the sheet stitching section and record a value of the determined timing in a memory upon pre-operation of the system, and measuring time elapsed from reception of the stack by the sheet stitching section based on the counted value of the encoder and sending a start up signal of operation to the sheet feeding section each time the measured time equals to the recorded value of the timing in operation of the system.

11. A book binding system for a saddle-stitched bound booklet, comprising:

a sheet feeding section feeding sheets or sets of sheets one by one;

a sheet folding section sequentially receiving a sheet or a set of sheets from the sheet feeding section and folding the sheet or the set of sheets along the center line thereof;

a sheet stacking section stacking the sheet or the set of sheets folded by the sheet folding section in such a manner that the folded sheets or the folded sets of sheets are aligned with each other with respect to the fold lines thereof;

a sheet stitching section receiving a stack of the sheets or the sets of sheets from the sheet stacking section each time the predetermined number of the sheets or the sets of sheets are stacked in the sheet stacking section, and stitching the stack of the sheets or the sets of sheets at the fold line thereof;

a control section controlling operation of the sheet feeding section, the sheet folding section and the sheet stitching section;

a frame; and wherein the sheet folding section comprises:

a sheet positioning table attached to the frame for sequentially receiving the sheet or the set of sheets from the sheet feeding section and positioning the sheet or the set of sheets in place;

a sheet conveying path extending from the sheet positioning table to the sheet stacking section, the sheet positioning table positioning the sheet or the set of sheets such that the center line of the sheet or the set of sheets aligns with the center line of the sheet conveying path;

upper and lower horizontal rotating shafts attached to the frame at the entrance of the sheet conveying path so as to be arranged one above the other with the sheet conveying path therebetween and extending in the direction transverse to the sheet conveying path;

a drive mechanism attached to the frame for rotating the upper horizontal rotating shaft;

upper and lower creasing rollers fixed to the upper and lower horizontal rotating shafts, respectively, the upper and lower creasing rollers being disposed at the position corresponding to the center line of the conveying path and bringing their outer periphery surfaces into contact with each other, the upper creasing roller being provided with a groove extending about the outer periphery thereof, the lower creasing roller being provided with a protrusion extending about the outer periphery thereof correspondingly with the groove, the groove and the protrusion being disposed at a position corresponding to the center line of the conveying path, the sheet or the set of sheets on the sheet positioning table being nipped between the upper and lower creasing rollers and provided with an inverted V-shaped fold line thereon;

at least one horizontal support shaft attached to the frame at a downstream side of the horizontal rotating shafts;

a guide roller rotatably attached to the at least one horizontal support shaft at a position corresponding to the center line of the sheet conveying path, an outer periphery edge thereof upwardly pushing the fold line of the sheet or the set of sheets traveling on the sheet conveying path;

a pair of vertical support shafts attached to the frame at the exit of the sheet folding section conveying path and extending downwardly from the frame across the sheet conveying path at the both sides of the center line of the sheet conveying path;

a pair of press rollers rotatably attached to the lower ends of the vertical support shafts, each of the press rollers being composed of a large radius portion and a small radius portion connecting to the underside of the large radius portion, the press rollers bringing their outer periphery surfaces into contact with each other at a position corresponding to the center line of the sheet conveying path, the sheet or the set of sheets being nipped at its peripheral portion folded along the fold line between the press rollers and fed downstream;

pulleys fixed to the upper horizontal rotating shaft at both sides of the upper creasing roller; and a first endless belt extending between the pulley and the small radius portion of the press roller at one side of the center line of the sheet conveying path, and a second endless belt extending between the pulley and the small radius portion of the press roller at the other side of the center line of the sheet conveying path, portions of the first and second endless belts which travel in a feeding direction of the sheet or the set of sheets contacting with a top surface of the sheet or the set of sheets and gradually narrowing the spacing therebetween towards the exit of the sheet folding section;

whereby the sheet or the set of sheets is folded into an inverted V-shape along the center line thereof by being passed between the upper and lower creasing rollers, conveyed along the sheet conveying path by the at least one guide roller and the first and second endless belts and passed between the pair of press rollers.

12. A book binding system for a saddle-stitched bound booklet, comprising:

a sheet feeding section feeding sheets or sets of sheets one by one;

a sheet folding section sequentially receiving a sheet or a set of sheets from the sheet feeding section and folding the sheet or the set of sheets along the center line thereof;

a sheet stacking section stacking the sheet or the set of sheets folded by the sheet folding section in such a manner that the folded sheets or the folded sets of sheets are aligned with each other with respect to the fold lines thereof;

a sheet stitching section receiving a stack of the sheets or the sets of sheets from the sheet stacking section each time the predetermined number of the sheets or the sets of sheets are stacked in the sheet stacking section, and stitching the stack of the sheets or the sets of sheets at the fold line thereof; and a control section controlling operation of the sheet feeding section, the sheet folding section and the sheet stitching section, the control section comprising:

a sheet sensor disposed between the sheet folding section and a sheet stacking section for detecting passage of the predetermined number of the sheets or the sets of sheets;

a subsidiary rotary shaft coaxially coupled to the input rotary shaft of the index unit;

a pulse plate fixed to the subsidiary rotary shaft for generating a pulse every time it rotates a given amount of angle;

an encoder for counting pulses generated by the pulse plate;

a disc fixed to the subsidiary rotary shaft and having an extension strip at its periphery;

an initial position sensor for detecting an initial position of the conveying craw of the sheet conveying mechanism of the sheet stitching section in which the conveying claw is positioned at an upstream side of the sheet stacking section by detecting the extension strip of the disc; and a processing unit measuring time from start up of operation of the sheet feeding section to stacking of the predetermined number of the sheets or the sets of sheets in the sheet stacking section based on a detection signal from the sheet sensor so as to determine the timing of operation of the sheet stitching section and record a value of the determined timing in a memory upon pre-operation of the system, and measuring time elapsed from reception of the stack by the sheet stitching section based on the counted value of the encoder and sending a start up signal of operation to the sheet feeding section each time the measured time equals to the recorded value of the timing in operation of the system.

* * * * *